US005409211A

United States Patent [19]

Adamek

[11] Patent Number: 5,409,211

[45] Date of Patent: Apr. 25, 1995

[54] BASKETBALL RETURN DEVICE

[76] Inventor: Frank Adamek, 15 Old Stone Rd., Vernon, Conn. 06066

[21] Appl. No.: 172,473

[22] Filed: Dec. 27, 1993

Related U.S. Application Data

[63] Continuation-in-part of Ser. No. 101,763, Aug. 4, 1993, abandoned.

[51] Int. Cl.[6] ..... A63B 69/00

[52] U.S. Cl. ..... 273/1.5 A; 193/2 A; 193/32; 285/402

[58] Field of Search ..... 273/1.5 A, 395, 396; 403/97, 103; 285/401, 402, 272, 278–280, 282; 193/2 A, 32

[56] References Cited

U.S. PATENT DOCUMENTS

| | | | |
|---|---|---|---|
| 162,549 | 4/1875 | Hege | 403/97 |
| 295,922 | 4/1884 | Hood | 403/97 X |
| 3,565,225 | 2/1971 | Fay | 193/32 X |
| 3,814,421 | 6/1974 | Spier, Jr. | 273/1.5 A |
| 3,889,908 | 6/1975 | Larson | 403/103 X |
| 3,917,263 | 11/1975 | Wiley | 273/1.5 A |
| 4,133,347 | 1/1979 | Mercer | 285/402 X |
| 4,184,814 | 2/1993 | Manning | 273/1.5 A |
| 4,579,339 | 4/1986 | Grimm | 273/1.5 A |
| 4,720,101 | 1/1988 | Farkas, Jr. | 273/1.5 A |
| 4,915,381 | 4/1990 | Hackett | 273/1.5 A |

*Primary Examiner*—Paul E. Shapiro
*Attorney, Agent, or Firm*—John R. Doherty

[57] ABSTRACT

A basketball return device for enhancing individual shooting practice time is provided which is safe and easy to install and which effectively returns all successful basketball shots to the shooter at any preselected location on the basketball court. This device attaches to a standard basketball goal including a metal ring and a nylon or chain net, for example, and is composed of a mounting ring and a retaining member. The mounting ring and/or retaining member are attached to the rim or net by a plurality of elongated, self-supporting adjustable hooks. A curved chute adjustably attaches to the mounting ring and guides the basketball back to the shooter.

20 Claims, 5 Drawing Sheets

BASKETBALL RETURN DEVICE

RELATED APPLICATIONS

This is a continuation-in-part of application Ser. No. 08,101,763 filed on Aug. 4, 1993, now abandoned.

BACKGROUND OF THE INVENTION

This invention relates to a device for returning a basketball to the shooter at a desired location on a basketball court. More particularly, the invention relates to a basketball return device which attaches to and can be easily removed from the rim or net of a basketball goal without the use of a ladder.

Repetitive practicing a skill has been proven to be a key factor in developing consistent performance in athletics. Doing so is particularly important in the game of basketball. The object of the game of basketball is to shoot the ball through a goal. The goal includes a circular rim having an inverted truncated conical net, typically constructed of nylon rope, suspended beneath the rim. Basketball players spend a great deal of time repetitively shooting the basketball through the net to improve their shooting performance.

A majority of the time, a basketball which passes through the basketball goal will drop straight beneath the net. Therefore, the practicing shooter must either rely upon an assistant to return the ball or leave his or her shooting position and walk over to the goal to retrieve the ball.

A number of basketball return devices have been introduced in recent years. In general, these devices permit a practicing shooter to repeat his or her shots from a given location on the court without having someone to retrieve the ball. These prior art devices fall into two general categories: (1) return devices designed to return all basketballs shot in the direction of the goal; and (2) return devices designed to return only basketballs which pass through the basketball goal.

The first category of prior art devices, that is, those designed to return all shot basketballs, typically consist of a large netting structure supported from the floor or hung on the backboard. Players must shoot the ball in a substantially arcked trajectory to insure that it will pass over the netting structure toward the goal. A portion of the missed shots rebound against the inside of the net enclosure and are funneled to a floor supported ball return track. These devices are typically cumbersome, quite costly and obstruct the shooter's view of the goal.

The second category of prior art devices, that is, those designed to return only made shots which pass through the basketball goal, typically consist of a short track or chute rigidly mounted to the backboard or rim of the goal. The capabilities of these devices are very limited since they will direct made shots back toward the free throw area only in a direction perpendicular to the backboard. In many cases, a poorly shot ball is deflected by the rigid return structure and fails to roll properly down the short track.

All prior art basketball return devices require substantial effort for their installation and dismantling. This is a significant disadvantage for players who readily transfer from shooting practice to playing a real game on their basketball court. During the game, basketball players will not want any devices attached to the rim, backboard or net while playing because of their impact on the purity of the sport. Furthermore, with most prior art devices, the job of installing, removing and/or changing the return position on the court requires the use of a ladder which is cumbersome and, in many cases, unsafe.

While these prior art devices adequately return basketballs in most situations, a need remains for a practical basketball return device which can be installed and removed easily and quickly by players without the use of a ladder, which consistently returns the basketball to the shooter after all made shots, which does not impair the shooters' view of the goal or attach to the rim in such a way as to misdirect a practice shot, which can be adjusted to return the basketball to any position on the court easily and without the use of a ladder, and which will survive direct impact by missed basketball shots without damaging the device.

U.S. Pat. No. 5,184,814 issued to G. Manning on Feb. 9, 1993 discloses a basketball training device including a pair of superimposed rings, one of which rings supports a plurality of risers forming a chute for returning the basketball to the shooter. The other ring supports the device via several L-shaped straps or hooks attached to the basketball rim. The rings are movably connected to one another and allow the chute to be rotated for returning the basketball to a desired position on the court. However, the rings are restrained from movement in an upward direction by stop bars fixed to the straps and thus require adjustment using a ladder or complete removal of the device from the basketball rim.

SUMMARY OF THE INVENTION

It is an object of this invention to provide an improved basketball return device which is easy and safe to install and remove and which will consistently return the basketball to the shooter at any location on the basketball court after all made shots. It is another object of this invention to provide an improved basketball return device which does not impair the shooter's view of the goal or a shot attempt at the goal. It is a further object of this invention to provide a durable basketball return device which will survive direct impacts by a basketball.

The invention is directed to a basketball return device which can be easily attached to the rim or net of a basketball goal. The device includes a mounting ring and a retaining member spaced above the ring. The retaining member has an opening which is substantially aligned with the opening in the mounting ring. The mounting ring and retaining member are both of a size which will allow passage of a basketball therethrough. The mounting ring and retaining member are attached to a basketball rim or net using a plurality of elongated, self supporting hooks connected to either the mounting ring or the retaining member or both. The mounting ring has a circumferential rim which is provided with at least two notches. The ring is also provided with locking means on the surface thereof, such as a plurality of serrations, ribs, grooves or the like. A funneled shaped, curved chute is removeably attached to the mounting ring at its inlet end and has an outlet end which is directed to a desired location on the basketball court. The inlet end of the chute has a configuration forming an opening with a peripheral rim corresponding substantially to the opening in the mounting ring. The inlet end is further provided with at least two extension members such as tabs, dowels, pins or the like of a size sufficient to fit through the notches and rest on the circumferential rim of the mounting ring. The extension members include locking means which mate with the locking means on the circumferential rim to lock the chute in place on the mounting ring. When the chute is lifted upwardly away from the mounting ring, the extension members provided at the inlet end of the chute make contact with the retaining member and force the hooks to disengage from the rim or net so that the device can be readily removed from the basketball goal.

A person of average height can easily lift the return device from the base of the curved chute to release the hooks attached to the basketball rim or net without using a ladder. The return chute is connected to the mounting ring in such a manner that the direction of the return chute can be changed easily by rotating it from its base. Within the back side of the funnel shaped chute, a pocket may be provided to which weight such as sand may be added. This keeps the unit from swaying abruptly away from its position directly below the basketball net when struck by a basketball, enhancing the performance of this return device.

In a preferred embodiment of the invention, the mounting ring and retaining member of the return device can be integrally made together in the form of a one-piece cylindrical, C-shaped body. The cylindrical body can also be provided with a conical or frustroconical surface surrounding the opening therein which helps to guide the basketball therethrough.

BRIEF DESCRIPTION OF THE DRAWINGS

The invention will now be described in greater detail with particular reference to the accompanying drawing, wherein.

DESCRIPTION OF THE PREFERRED EMBODIMENTS

Figure 1:
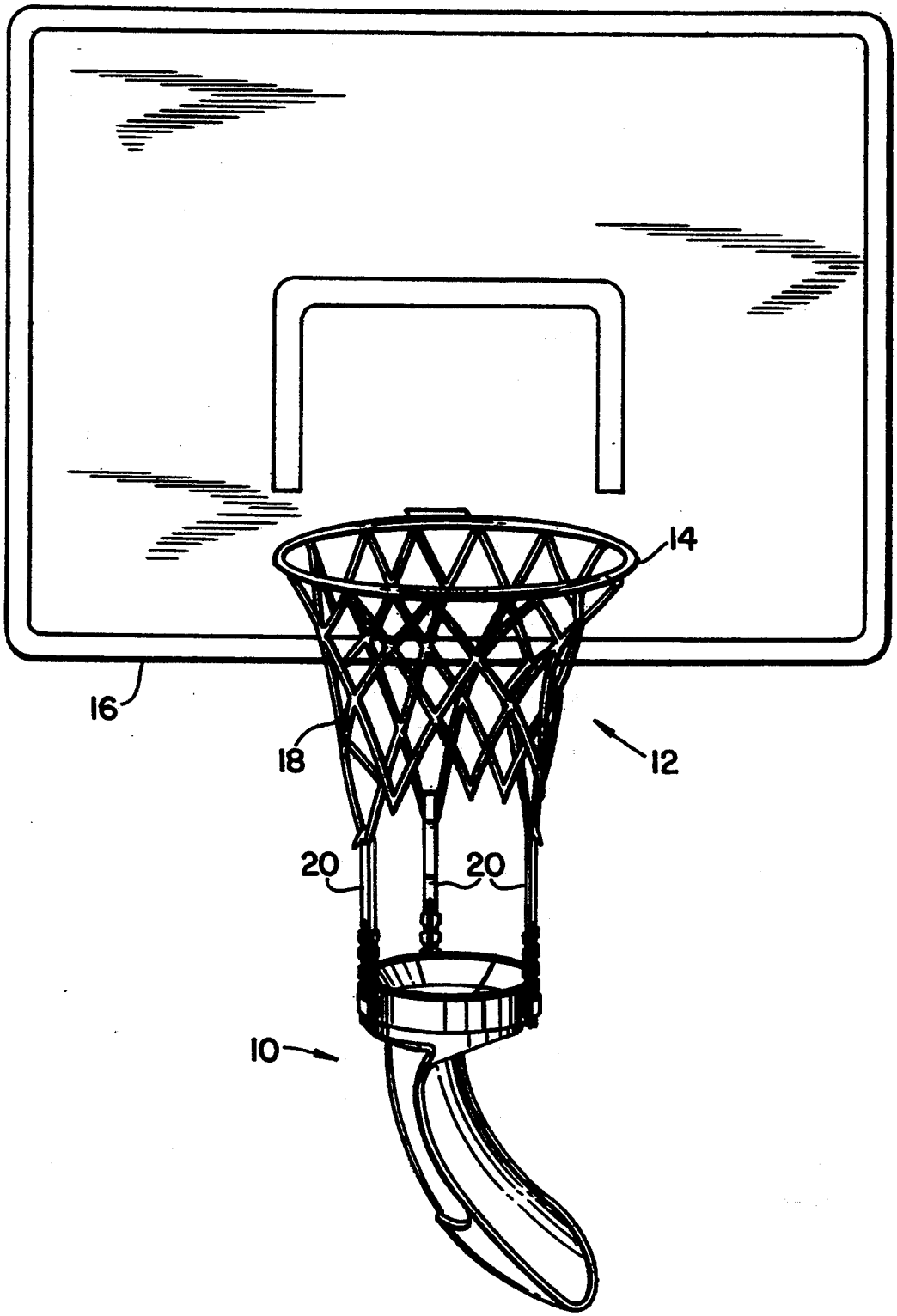
FIG. 1 is a perspective view of a basketball return device according to the invention.

Referring now to the drawings and particularly to FIG. 1, a basketball return device 10 according to the invention is shown mounted onto a conventional basketball goal generally indicated at 12. The basketball goal 12 includes a circular rim 14 attached to a backboard 16 and an inverted, conical basketball net 18 made of nylon or chain, for example, which is suspended from the rim 14. The return device 10 in this embodiment is mounted to the net 18 using a plurality of elongated, durable, self-supporting hooks 20, there being three such hooks employed in the device shown in the drawing. The hooks 20 are preferably made of molded plastic and are provided with a wide flange 22 (see FIG. 2) at their upper ends where they touch the basketball net 18 or the rim 14. This spreads the weight of the device more evenly across the net at the points of contact and reduces wear and tear on the net and the chances for net breakage. The hooks 20 can be adjusted to any one of several different lengths as shall be described hereinafter in greater detail, which allows the return device to be attached to the net by most people of average height without the use of a ladder.

As shown more particularly in FIGS. 2–6, inclusive, the basketball return device 10 includes a circular, molded plastic, mounting ring indicated generally at 24. The mounting ring 24 has a generally C-shaped configuration including cylindrical side walls 26, a lower circumferential lip 28 and an upper retaining rim 30 spaced a short distance above the lip 28. The openings in the mounting ring 24, surrounded by the rim 28 at the bottom end and by the retaining rim 30, are substantially aligned with one another but need not be exactly the same size so long as both openings are at least slightly larger in diameter than that of a basketball.

Figure 9:
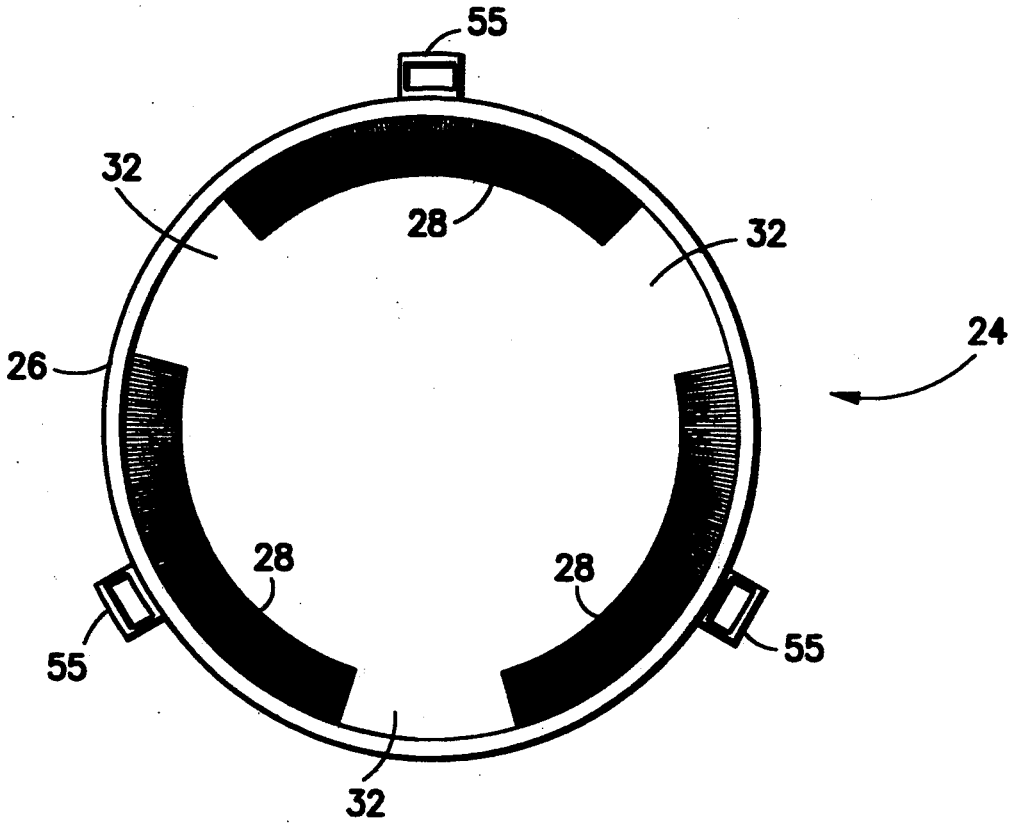
FIG. 9 is a top plan view of the mounting ring taken along the lines 9—9 in FIG. 4.

The lower circumferential rim 28 is provided with a plurality of notches 32 (see FIG. 9) formed on its inner peripheral edge, there being three such notches shown in the embodiment of the device illustrated. As shown more particularly in FIG. 3, the rim 28 also has a plurality of V-shaped grooves or serrations 34 disposed radially on its upper surfaces.

A curved basketball return chute 36 is adjustably mounted inside the mounting ring 24. The chute 36 is shaped somewhat like a funnel having an elongated, generally semicircular, curved track or body portion 38 extending between its inlet and outlet ends. The inlet end of the chute 36 has a circular rim 40 which is provided with a plurality of outwardly extending members such as tabs 42, there being three such tabs show in the drawing. The circular rim 40 is larger in diameter than a basketball but is slightly smaller than the central opening in the mounting ring 24. Thus the rim 40 of chute 36 will fit easily through the mounting ring 24 when the three tabs 42 are aligned with the three notches 32 in the circumferential rim 28 (see FIG. 9).

The tabs 42 are formed on their underneath side with a plurality of V-shaped projections 44 which compliment the grooves 34 provided on the surface of the circumferential rim 28. The projections 44 and groves 34 interlock with each other and hold the chute 36 firmly in place within the mounting ring 24. It will be seen that the chute 36 can be easily adjusted to point its outlet end toward any location on the basket court by simply lifting the chute upwardly to disengage the projections 44 from the grooves 34 and then rotating the chute to the desired position.

The installation and operation of the basketball return device 10 will now be described with particular reference to FIGS. 2–6, inclusive. The user holds up the device by the base of the ball return chute 36, which in turn forces the rim 40 and/or tabs 42 against the retaining rim 30 on the circular mounting ring 24 (see FIG. 4). Since the firm, self-supporting hooks 20 are attached to the side walls 26 of the mounting ring 24, the entire unit is of sufficient length to reach the basketball rim or net and be hooked into place for installation. As shall be described in greater detail hereinafter, the hooks 20 may be provided with a series of complementary locking protuberances 46 on opposite sides of the hooks for attachment to the mounting ring 24. The protuberances 46 enable the hooks to be adjusted to variable lengths so that the basketball return device can be positioned at the proper distance below the net 18. Once hooked into place, gravity allows the unit to rest solidly under the net and rim (FIG. 5). FIG. 6 illustrates how quick, easy and safe it is to change the direction of the ball return chute 36. The user again holds onto the base of the ball return chute 36 and lifts it slightly. This raises the lip 40 of the chute off the grooves 34 of the lower lip 28 of the mounting ring 24. Within the cavity of the circular mounting ring 24, there is enough space to rotate the extension or tabs 42 in any direction without lifting the vertical hooks 20 off the basketball net.

Figure 7:
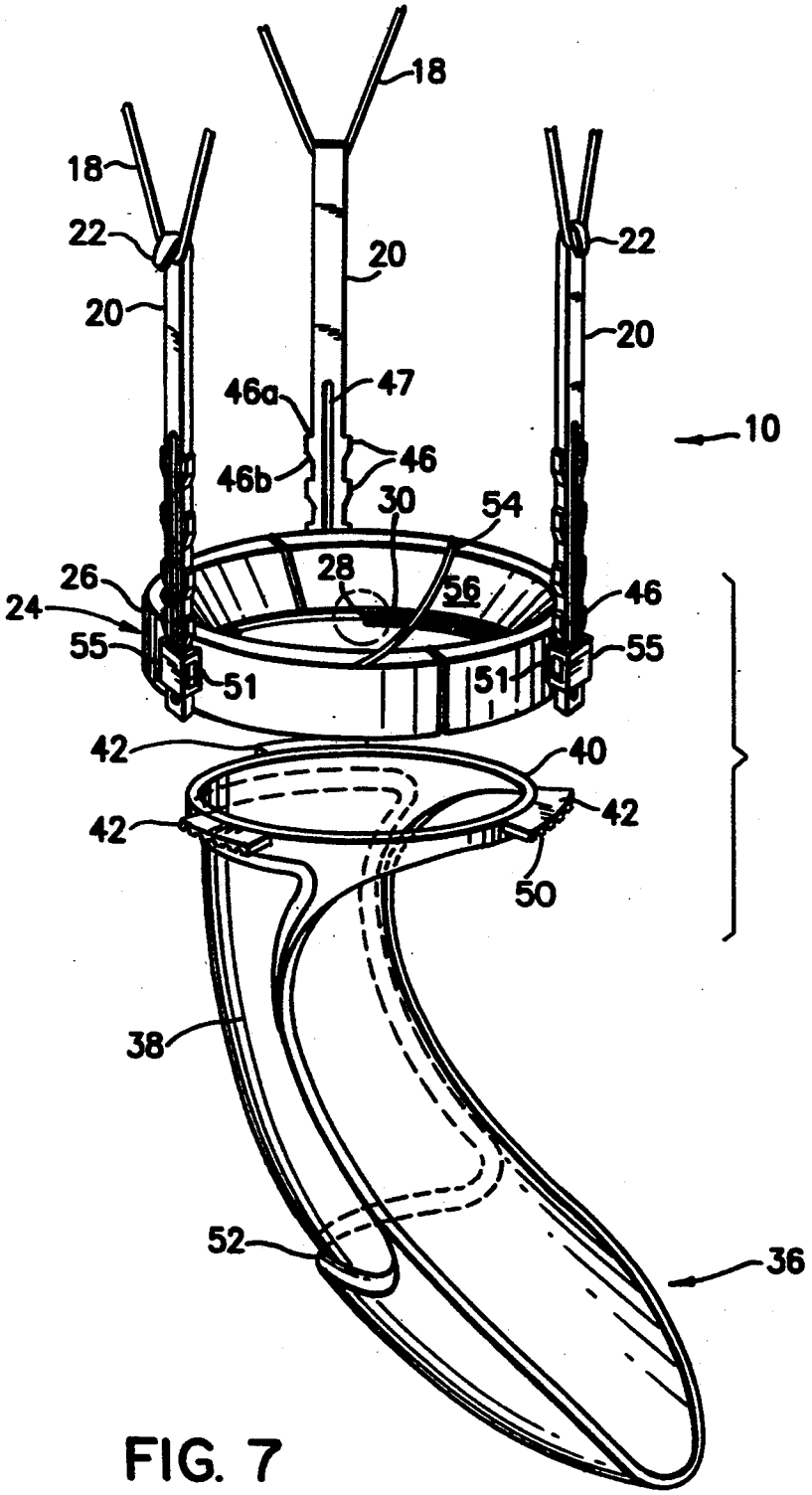
FIG. 7 is a view similar to FIG. 2 but showing a different form of locking means employed on the mounting ring.
Figure 8:
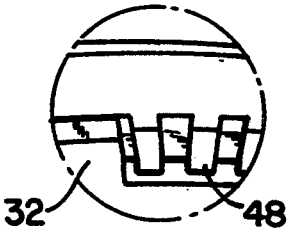
FIG. 8 is an enlarged, fragmentary, perspective view of the locking means shown in FIG. 7.

FIGS. 7 and 8 show another embodiment of the return device. This embodiment uses a pattern of high and low rectangular block shaped projections 48 on the lower lip 28 of the circular mounting ring 24. These projections 48 line up with an opposite but equal pattern of block shaped projections 50 on the underneath side of the extensions or tabs 42.

The ball return chute 36 is preferably made from a firm solid plastic-like material which can be composed of any color, making the device attractive in appearance. This also accommodates the ability to mirror the color of this device with that of a local school, club, or professional sports team. The inner surface of the ball return chute 36 also provides an area to support a logo if desired. The chute 36 should also have adequate weight to hold it via gravity predominately below the rim and net. In the preferred embodiment of the ball return device, the chute 36 extends only a short distance below the net 18 and the back side of the chute 36 includes a pocket 52 to which weight such as sand can be added. This allows the user to adjust the performance of the ball return device by better holding the coupled device firmly under the net, reducing lateral movement caused by ball contact. As shown in FIG. 7, an elastic band 54 or similar device may also be disposed diametrically across the mounting ring 24. This band will slow the decent of the ball through the circular mounting ring 24 on either side of the band, enhancing the consistency of the ball returning to the shooter.

As indicated hereinabove, the hooks 20 can be attached to the mounting ring 24 at variable lengths by means of a series of complementary locking protuberances 46 provided on opposite sides of the hook. This enables the basketball return device to be easily adjusted to the proper distance below the net 18.

Figure 2:
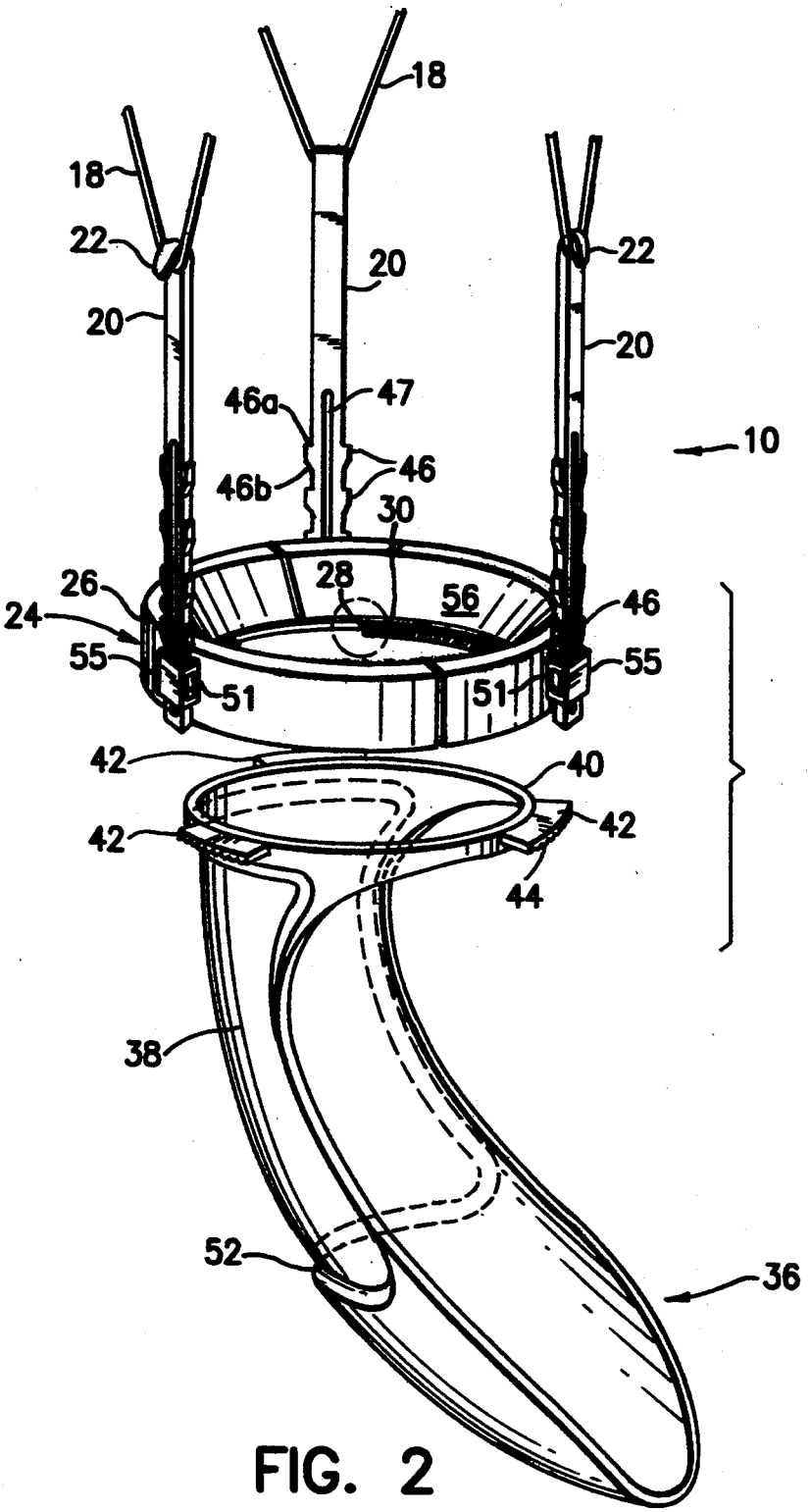
FIG. 2 is an enlarged perspective view of a mounting ring and a return chute employed in the basketball return device shown in FIG. 1.
Figure 3:
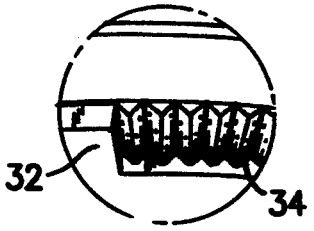
FIG. 3 is an enlarged, fragmentary, perspective view of a mounting ring having a series of V-shaped grooves on its surface providing a locking means according to the invention.

As best seen in FIGS. 2 and 7, the pairs of locking protuberances 46 are complementary forming mirror images of each other on each side of the hook 20. The protuberances 46 include upper locking surfaces **46*a* which extend laterally outward from each side of the hook 20 in coplanar relation to one another. The protuberances 46 also include inwardly tapered, cam-acting surfaces 46*b* which extend downwardly away from the locking surface 46*a***.

Disposed between the locking protuberances 46 within the approximate mid-section of each hook 20 is an elongated slot 47. This slot 47 is of sufficient width to allow compression of the hooks when the protuberances 46 are squeezed together or inwardly in the lateral direction.

Each hook 20 is mounted through a hollow rectangular lock fastener 55 secured to the side wall 26 of the mounting ring 24, there being three such fasteners shown in substantially equidistant spaced apart relation on the ring 24. The lock fasteners 55 are open at the top and bottom ends to allow passage therethrough of the hooks 20. The fasteners 55 are also formed with elongated, substantially rectangular lock openings 51 on each side for receiving simultaneously the pair of complementary protuberances 46 on opposite sides of the hooks 20.

It will be seen that each hook 20 can be easily pushed downwardly through the top open end of its respective lock fastener 55, each of the cam-acting surfaces **46*b* acting against the side walls of the fastener to compress the hook 20 and allow the protuberances 46 to pass easily through the fastener. However, when the hooks 20 are pulled through the fasteners 55 in the opposite direction or upwardly toward the rim or net 18, the locking surfaces 46*a* engage the top edge of the openings 51 and lock the hooks in place at a predetermined length depending upon the particular position of the protuberances 46. In the embodiment illustrated, there are four sets of complementary protuberances 46 and thus four alternative locations at which the hooks can be positioned below the basketball net 18**.

To unlock the hooks 20, it is a simple matter to compress the two complementary protuberances 46 on opposite sides of the hook 20 to release the protuberance from the lock openings 51. The hooks can then be raised or lowered to a new location and locked in place in the same manner as described above.

Figure 4:
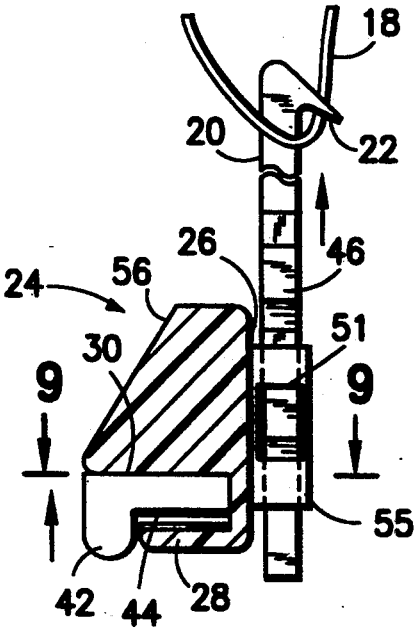
FIG. 4 is a side elevational view of part of the return device showing the device as it appears during installation.
Figure 5:
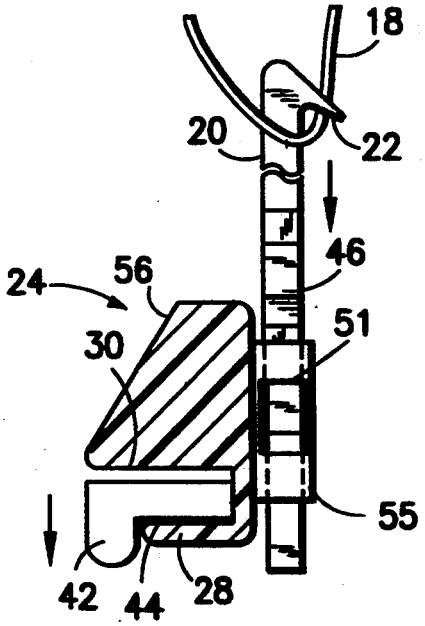
FIG. 5 is a similar view of the return device in its operating mode after installation.
Figure 6:
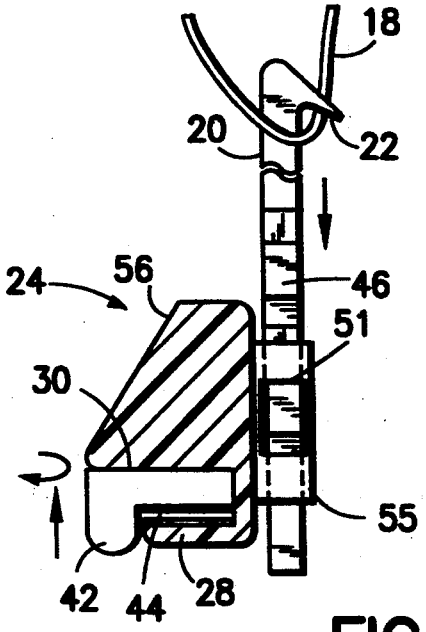
FIG. 6 is a similar view of the return device as it appears during rotation of the chute for changing the ball return direction.

The mounting ring 24 may also be provided with a conical or frusto-conical inner surface 56 at its uppermost end as probably best shown in FIGS. 4–6, inclusive. The inner conical surface 56 helps to guide the ball more easily through the top opening of the mounting ring 24.

Many modifications of the basketball return device of the invention are of course possible. For example, although the device has been described herein as employing a one piece mounting ring, it will be understood that the device can also employ a separate mounting ring and retainer member connected together in basicly the same manner as shown in the drawing and wherein the elongated, self supporting hook members are attached to either the mounting ring or the retaining member or both. Of course, the hook members may be attached to the basketball hoop assembly in general, that is, to either the basketball rim or the net as shown in the drawing. Other modifications will of course occur to those skilled in the art.

What is claimed is:

1. A basketball return device adapted for mounting to the rim or net of a basketball goal comprising, in combination:

a mounting ring having a substantially circumferential surface provided with at least two notches thereon, said surface having locking means thereon;

a retaining member spaced above said mounting ring, said retaining member having an opening substantially aligned with the opening in said ring, each of said openings being of a size sufficient to allow passage of a basketball therethrough;

means for attaching said mounting ring to said rim or net including a plurality of elongated, substantially self-supporting hook members connected to at least one of said mounting ring and said retaining member, said elongated hook members extending above said retaining member for engaging said rim or net;

a curved basketball return chute having inlet and outlet ends, said inlet end having a configuration forming a peripheral rim corresponding substantially to said opening in said retaining member and having at least two extension members thereon, said extension members being of a size sufficient to pass through said notches in said mounting ring and rest on said circumferential surface, said extension members having locking means thereon which mate with said locking means on said circumferential surface to lock said chute in place in any desired angular position with respect to said net; the arrangement being such that when said chute is lifted upwardly away from said mounting ring at least one of said peripheral rim and said extension members make contact with said retaining member and force said hooks to disengage from said net.

2. A basketball return device according to claim 1 wherein said extension members are tabs extending outwardly from said peripheral rim.

3. A basketball return device according to claim 2 wherein said locking means on said circumferential surface comprises a plurality of V-shaped grooves.

4. A basketball return device according to claim 3 wherein said locking means on said extensions members comprise a plurality of V-shaped grooves which mate with said plurality of V-shaped grooves on said circumferential surface.

5. A basketball return device according to claim 2 wherein said locking means on said circumferential surface comprise a pattern of rectangular shaped ribs.

6. A basketball return device according to claim 5 wherein said locking means on said extension members comprise a pattern of spaced rectangular shaped ribs which mate with said pattern of rectangular shaped ribs on said circumferential surface.

7. A basketball return device according to claim 1 wherein said chute includes a pocket for carrying weight to stabilize said device.

8. A basketball return device according to claim 1 wherein said chute includes indicia on the surface thereof.

9. A basketball return device according to claim 1 wherein at least one of said mounting ring and said retaining member is provided with an elastic band extending diametrically across said opening therein to slow the decent of the ball passing through said device.

10. A basketball return device according to claim 1 wherein said mounting ring and said retaining member are molded in one piece from a plastic material.

11. A basketball return device according to claim 10 wherein said one piece molded plastic mounting ring and retaining member has a C-shaped configuration including a lower circumferential lip and an upper retaining rim.

12. A basketball return device according to claim 11 wherein said lower circumferential lip has at least two notches therein.

13. A basketball return device according to claim 12 wherein said lower circumferential lip includes said locking means thereon.

14. A basketball return device according to claim 11 wherein said elongated hook members are attached to said one piece molded plastic mounting ring and retaining member.

15. A basketball return device according to claim 14 wherein said hook members include means for adjusting the length of said hooks.

16. A basketball return device according to claim 15 wherein said adjusting means includes a series of protuberances on the opposite side edges of said hook members, said protuberances extending through openings in said lock fasteners.

17. A basketball return device according to claim 15 wherein said protuberances include laterally extending locking surfaces and inwardly directed cam-acting surfaces.

18. A basketball return device according to claim 17 wherein said hook members include an elongated slot extending between said protuberances allowing compression of said hook members when said cam-acting surfaces pass through said lock fasteners.

19. A basketball return device according to claim 11 wherein said hook members are attached to said one piece molded plastic mounting ring and retaining member via hollow lock fasteners secured to the side walls thereof.

20. A basketball return device according to claim 11 wherein said retaining member includes a conical shaped surface which guides the basketball through the opening therein.

* * * * *